United States Patent [19]

Cook et al.

[11] Patent Number: 4,469,036

[45] Date of Patent: Sep. 4, 1984

[54] ELECTRICALLY ISOLATING SEWING MACHINE MOTOR MOUNT

[75] Inventors: Albert N. Cook, Madison; Louis F. Daman, Warren Township, Somerset County, both of N.J.

[73] Assignee: The Singer Company, Stamford, Conn.

[21] Appl. No.: 432,510

[22] Filed: Oct. 4, 1982

[51] Int. Cl.[3] ..... D05B 69/12

[52] U.S. Cl. ..... 112/220; 474/115; 112/270

[58] Field of Search ..... 474/115; 112/220, 270; 248/669; 310/91

[56] References Cited

U.S. PATENT DOCUMENTS

| | | | |
|---|---|---|---|
| 2,018,624 | 10/1935 | Eames | 112/220 |
| 2,205,176 | 6/1940 | Sauer | 474/115 |
| 3,051,109 | 8/1962 | Bialy . | |
| 3,326,158 | 6/1967 | Graham . | |
| 3,382,728 | 5/1968 | Takahashi . | |
| 3,563,196 | 2/1971 | Nicolay . | |
| 3,760,209 | 9/1973 | Hult | 310/91 |
| 4,240,368 | 12/1980 | Adams . | |
| 4,350,104 | 9/1982 | Cook | 112/220 |

*Primary Examiner*—Peter Nerbun
*Assistant Examiner*—Andrew M. Falik
*Attorney, Agent, or Firm*—William V. Ebs; Robert E. Smith; Edward L. Bell

[57] ABSTRACT

An electric motor is supported at one end on a molded plastic electrically non-conducting housing which is slidably mounted on the metallic frame of a sewing machine at the base and which is biased toward the base of a compression spring to set tension in a belt through which the motor drives a pulley on the arm shaft of the sewing machine.

6 Claims, 3 Drawing Figures

ELECTRICALLY ISOLATING SEWING MACHINE MOTOR MOUNT

DESCRIPTION

Field of the Invention

The invention relates to mounting arrangements for electric motors in sewing machines.

BACKGROUND OF THE INVENTION

It is well known to adjustably mount an electric motor on a sewing machine in such fashion as to permit the motor to be selectively positioned for the purpose of setting tension in a belt operatively connecting the output shaft of the motor with a pulley affixed to the arm shaft of the sewing machine. It is also known to employ various devices to electrically isolate a motor from a metallic sewing machine frame. However, the prior designs providing for the adjustment of belt tension and electrical isolation of a motor have substantially added to the cost of a sewing machine because of their complexity. Also, the electrically isolating devices have often proved to be less than satisfactory.

It is a prime object of the present invention to provide an improved and simplified mount for an electric motor on a sewing machine effective to set tension in a belt connecting the motor shaft with an arm shaft pulley, and to electrically isolate the motor from the machine frame in an enduring fashion preventing electrical shock to a machine operator.

Other objects and advantages of the invention will become apparent during a reading of the specification taken in connection with the accompanying drawings.

SUMMARY OF THE INVENTION

In accordance with the invention, an electric motor for use in driving a sewing machine is affixed at one end to a molded plastic electrically non-conductive housing which is mounted on the frame of the machine for slidable motion in a plane parallel to the plane of a belt that connects the motor shaft to an arm shaft pulley. A compression spring is arranged to bear downwardly on the housing and set tension in the belt according to the position of a jack screw with which the plastic housing may be raised against the bias of the compression spring.

DESCRIPTION OF THE PREFERRED EMBODIMENT OF THE INVENTION

Figure 2:
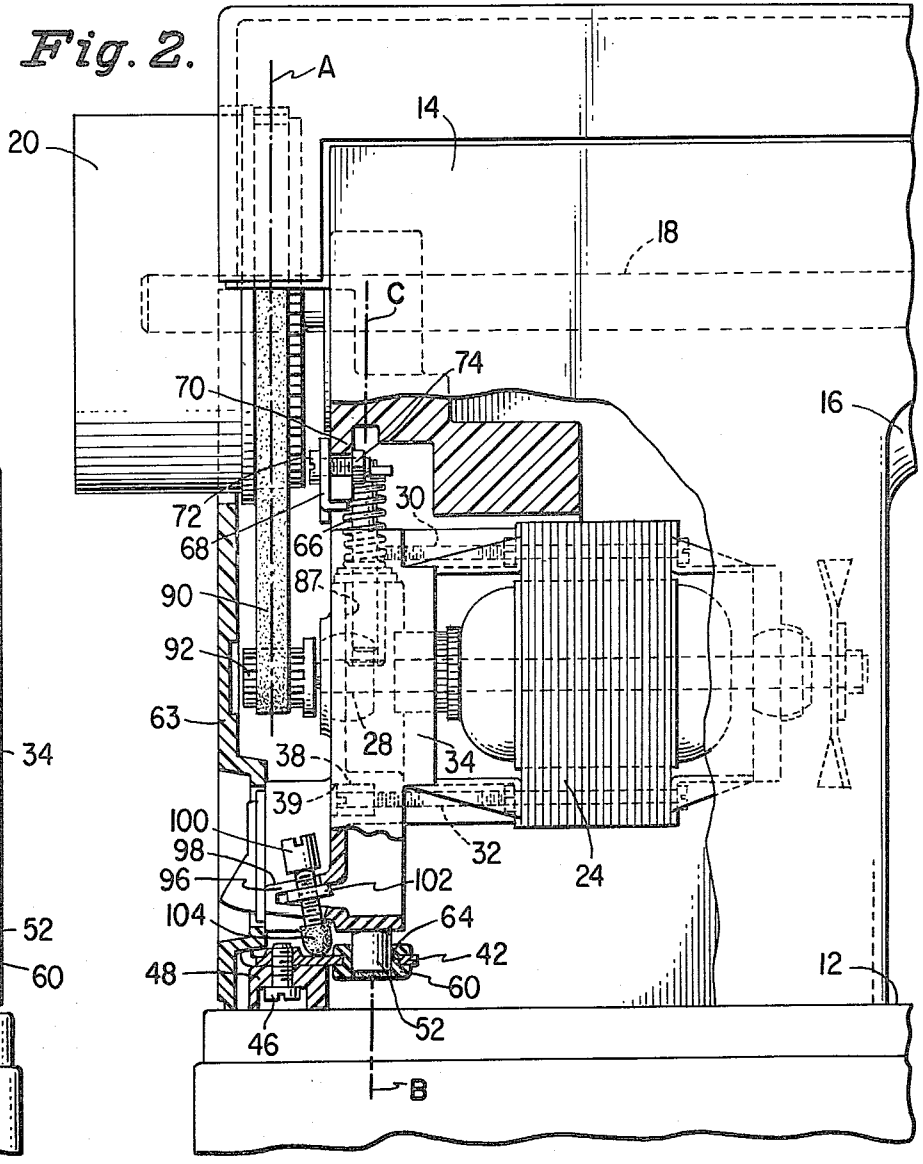
FIG. 2 is a fragmentary front elevational view of the sewing machine showing the motor mount; and, FIG. 3 is an exploded perspective view of the motor mount.
Figure 1:
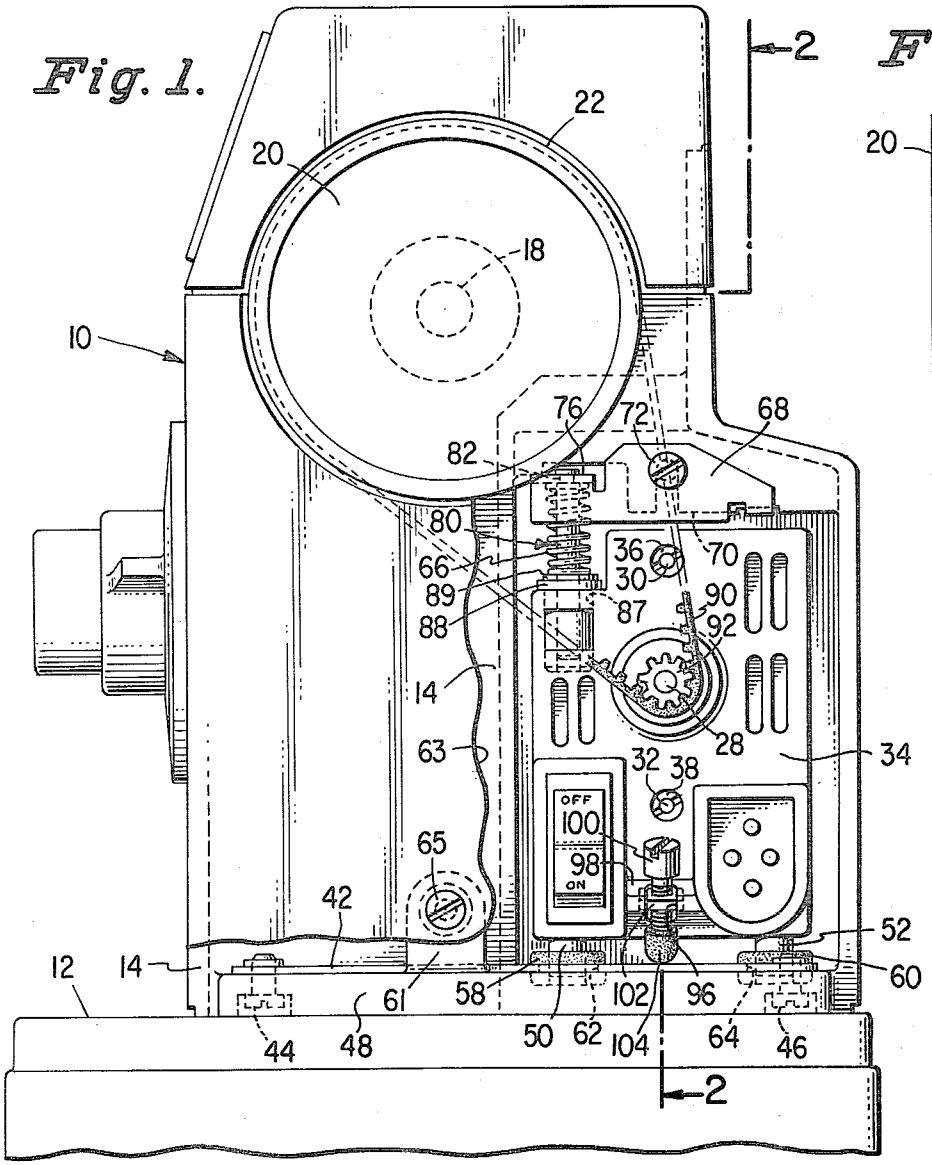
FIG. 1 is a standard-end elevational view of a sewing machine incorporating the motor mount of the invention.
Figure 3:
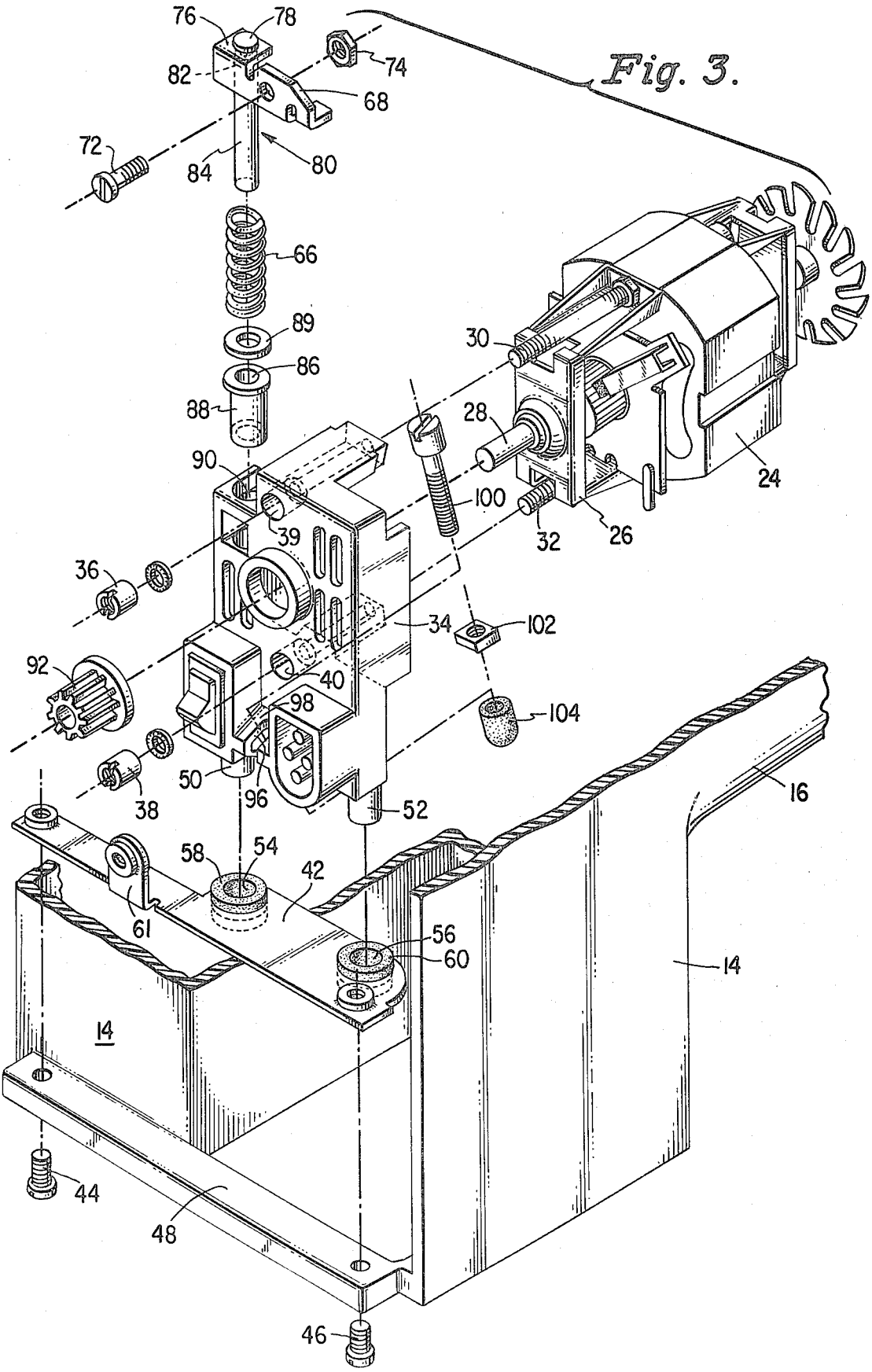

Referring to the drawings, reference character 10 designates a family type sewing machine having a metallic frame which includes a work supporting bed 12, a hollow standard 14 rising from one end of the bed, and a hollow bracket arm 16 extending laterally from the standard over the work supporting bed. An arm shaft 18 journalled in the bracket arm 16 has a handwheel 20 affixed thereto. A pulley 22 for driving the arm shaft is an integral part of the handwheel.

An electric motor 24 is mounted on the machine in accordance with the invention. Such motor includes a fixed end bracket 26 through which the output shaft 28 of the motor extends, and fixed end threaded rods 30 and 32 which project from the bracket 26. The motor is attached to an electrically non-conductive molded housing 34 of plastic with internally threaded sleeve like members 36 and 38 which engage the threaded ends of rods 30 and 32, respectively, in shouldered holes 39 and 40 in the housing.

Housing 34 is slidably mounted on the sewing machine in a plate 42 which is secured by screws 44 and 46 to a bottom transversely extending flange portion 48 of the standard 14. As shown, housing 34 includes spaced apart depending legs 50 and 52. The legs are slidable in the holes 54 and 56 of electrically insulating rubber grommets 58 and 60 which are retained in through openings 62 and 64, respectively, in plate 42. As shown, the plate includes an upright flange 61 to which an end cover 63 is attached with a screw 65.

A compression spring 66 is provided between an upper end portion of housing 34, and a member 68 which is secured to a depending flange 70 on the standard 14 with a bolt 72 and nut 74. Member 68 is formed with a flange 76 where one end portion 78 of a pin 80 is suitably affixed in a hole 82. An opposite end portion 84 of the pin extends through a hole 86 in a bushing 88 which is located in a hole 90 in housing 34. Spring 66 shown in the form of a helical coil spring, surrounds pin 80 and engages the underside of flange 76 as well as the top side of a bushing engaging washer 89. The spring acting through the washer and bushing exerts a downward force on housing 34.

The downward force exerted by compression spring 66 on block 34 produces tension in a belt 90 through which the motor 24 drives arm shaft 18. As shown, the belt extends from a driving element 92 affixed on the output shaft 28 of the motor to pulley 22 on the arm shaft 18. The plane A of the belt is parallel to the plane B in which the spaced apart depending legs 50 and 52 slidably mount the housing 34 on bed 12. The axis of spring 66 is in a plane C which is parallel to planes A and B.

As shown, housing 34 is formed with a lower end slot 96 in an inclined flange 98. A jack screw 100 extends through the slot and is threaded through a nut 102 in engagement with the underside of the flange. The lower end of the screw carries a plastic cap 104 which is engageable with plate 42. By turning the screw in one direction while the cap is against the plate, housing 34 may be raised against the bias of spring 66 to lessen tension in the belt, and by turning the screw in the other direction the spring is rendered effective to increase belt tension.

The belt 90 is readily removed and replaced. A lifting force is first exerted on the motor 24 to raise housing 34 in its slidable mount and loosen the belt. Belt 90 is then removed and a new belt is substituted for the old one. When the new belt is in place on driving element 92 and pulley 22 the motor is released whereupon the spring 66 takes over to tighten the belt.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. In a sewing machine with a metallic frame including a base and an upstanding standard; a drive shaft pulley, an electrically non-conductive housing slidably mounted for up-down translatory motion on the frame, an electric motor affixed at only one end on the housing and with the motor shaft extending through the housing to a location beyond the housing where the shaft carries a belt driving element in the plane of the drive shaft pulley, a belt operatively connecting said driving element on the motor shaft with the drive shaft pulley, and a compression spring on the machine arranged to exert a downward force on the housing and tighten the belt.

2. The combination of claim 1 wherein the spring extends in a plane which is parallel to the plane of the belt, and the housing is slidably mounted on the base in a plane which is also parallel to the plane of the belt.

3. The combination of claim 2 wherein the spring is a coil spiing.

4. The combination of claim 1 wherein the housing is a plastic molded part.

5. The combination of claim 1 wherein the housing is slidably mounted in the bed at spaced apart locations in a plane parallel to the plane of the belt.

6. The combination of claim 1 including means to raise the housing in the slidable mount therefor to lessen tension in the belt.

* * * * *